United States Patent [19]

Noble, deceased et al.

[11] Patent Number: 4,804,185

[45] Date of Patent: Feb. 14, 1989

[54] GAMES PLAYING APPARATUS

[76] Inventors: John B. Noble, deceased, late of Nottingham, England; by John A. Pearce, executor; by John J. V. Gossage, executor, both of 1 Talbot St., Nottingham, England

[21] Appl. No.: 91,712

[22] Filed: Sep. 1, 1987

[51] Int. Cl.[4] ..... A63F 9/20

[52] U.S. Cl. ..... 273/85 CP; 273/85 G; 273/DIG. 28; 273/138 R

[58] Field of Search ..... 273/85 CP, 85 G, 138 R, 273/138 A, 139, 292, DIG. 28, 149 P

[56] References Cited

FOREIGN PATENT DOCUMENTS 2118444 11/1983 United Kingdom ..... 273/85 G

*Primary Examiner*—Leo P. Picard

*Assistant Examiner*—Jessica J. Harrison

[57] ABSTRACT

An amusement machine on which a dominoes game can be played between a player and the machine comprises a domino-alotting apparatus which presents a selection of pairs of hands of dominoes (face up to the player) on a color monitor (10) and comprises selector buttons (12) enabling the player to choose from the selection offered the particular pair of hands to be played. The machine comprises an apparatus (14) enabling the player in his turn to select from his hand a domino to be played next, and whereby the machine can in its turn select from its hand a domino to be played next, the state of play being presented on the monitor. The selection of pairs of hands presented initially is chosen by the machine from a recorded register of notional pairs of hands suitable for games to be played.

1 Claim, 5 Drawing Sheets

GAMES PLAYING APPARATUS

There is described in United Kingdom patent specification No. 2 118 444 A games playing apparatus, in the form of an amusement machine, on which a dominoes game can be played between a player and the machine. The machine described in detail therein is a microprocessor-based machine employing a video screen for presentation of the state of play to the player. However, in games playing apparatus variable displays can be provided in various other ways, such as by means of reels or disks, flip-card units, cards or illuminated symbols.

The apparatus described in specification No. 2 118 444 A is of a type comprising dominoe-allotting means whereby from a notional set of dominoes certain dominoes can be allotted to the player and certain dominoes to the apparatus for a game to be played, means whereby the player can in his turn select from those allotted to him (i.e. his "hand") a dominoe to be played next, means whereby the apparatus can in its turn select from those allotted to it (i.e. its "hand") a dominoe to be played next, and means whereby there can be displayed (i.e. face up) to the player representations of the dominoes allotted to the player and to the apparatus and of the state of play as play proceeds, and games playing apparatus of this type is referred to hereinafter as apparatus of the kind hereinbefore defined.

In patent specification No. 2 118 444 A two suggestions are made as regards the allocation of hands of dominoes to the player and to the machine for a game. According to a first suggestion, the machine is programmed to select the two hands by random selection (from a notional conventional set of twenty-eight dominoes), there being no player involvement in the selection. In an alternative proposal, the player is able to select dominoes for himself from the set one at a time, the machine being programmed to make selections for its own hand alternately with the player.

It is an object of the present invention to provide improved games playing apparatus of the kind hereinbefore defined and in accordance with the invention, in one of its aspects, in such apparatus the dominoe-allotting means comprises means whereby from a register of notional pairs of hands of dominoes a selection of pairs can be chosen by the apparatus for presentation to a player, and means whereby the player himself can select from the pairs presented to him one pair with which the game is to be played.

For example, the apparatus may be arranged to choose (perhaps from many hundreds of available pairs recorded in the register) a selection of four pairs of hands for the player to make his choice. Where, for example, four pairs of hands are presented they are, in a preferred arrangement, presented as four single hands together with an indication to the player as to which of the other three hands the apparatus will play for each of the four hands which may be chosen by the player; such an arrangement amounts, of course, to the presentation by the apparatus of four predetermined pairs of hands from which the player is able to choose any one pair.

It is to be clearly understood that the term "register", as used in the last two preceding paragraphs, is not intended to be in any way limitative as to the manner in which or the means whereby the available notional pairs of hands are recorded, or as to the manner in which or the means whereby the dominoe-allotting means is able to choose therefrom a selection of pairs for presentation to a player.

It is also to be understood that whilst it may be preferred that the dominoe representations presented by the apparatus be of a traditional spot count form, other forms of dominoe (e.g. picture dominoes) could be presented.

There now follows a detailed description, to be read with reference to the accompanying drawings, of an amusement machine and its use which illustrate the invention by way of example.

Figure 1:
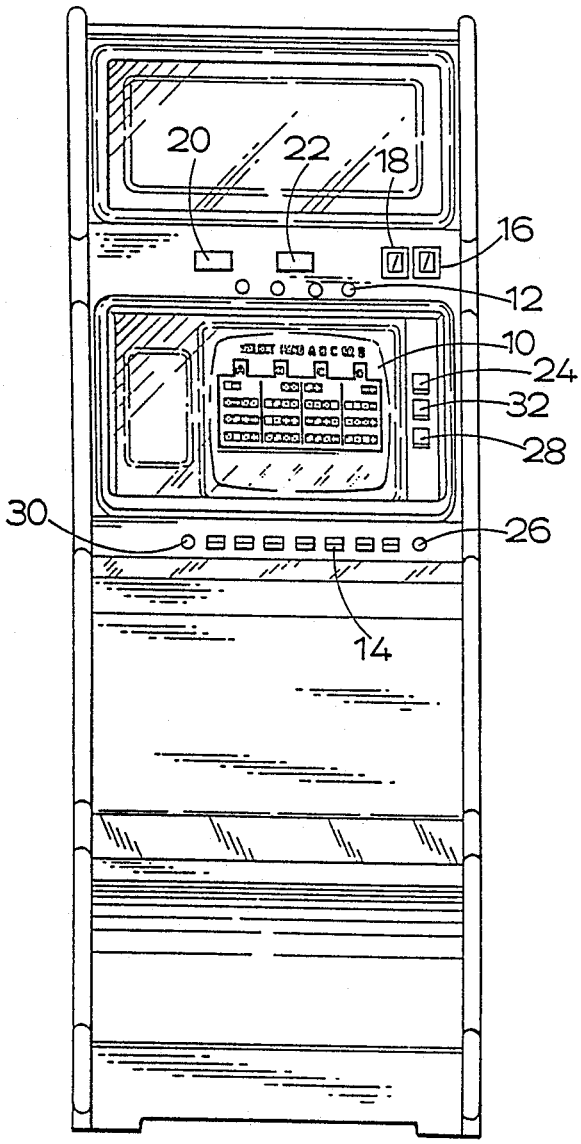
FIG. 1 is a view of the front of the machine.

The machine is for the playing of a dominoes game and is microprocessor-controlled. It comprises a colour monitor 10 for the presentation of a variable display of dominoe representations to a player.

The machine, comprising computer software for its operation, comprises dominoe-allotting means whereby a hand of dominoes can be allotted to the player and a hand of dominoes to the machine for a game to be played. The machine comprises means recording a register of many hundreds of notional pairs of hands of dominoes suitable for games to be played; the pairs of hands are chosen, as likely to give relatively evenly matched games, from a notional traditional set of twenty-eight spot-count dominoes. The dominoe-allotting means comprises means whereby the machine can choose from the register a plurality of pairs of hands for presentation (on the monitor 10) to an intending player, and means comprising four selector buttons 12 whereby the player himself can select from the pairs presented to him one pair with which the game is to be played. The machine further comprises means comprising seven move buttons 14 whereby the player can in his turn select from his hand a dominoe to be played next, and means whereby the machine can in its turn select from its hand a dominoe to be played next. Display means of the machine whereby there can be displayed to the player pictorial representations of the two hands and of the state of play as play proceeds comprises the colour monitor 10.

The machine resembles in construction a modern fruit machine, utilising the colour monitor 10 for its means of display. Coin entry slots 16 and 18 are provided for the insertion of coins and digital displays 20 and 22 indicate the value of credit (i.e. initially the total from coins inserted by the player) and the value staked for a game, respectively.

Figure 2:
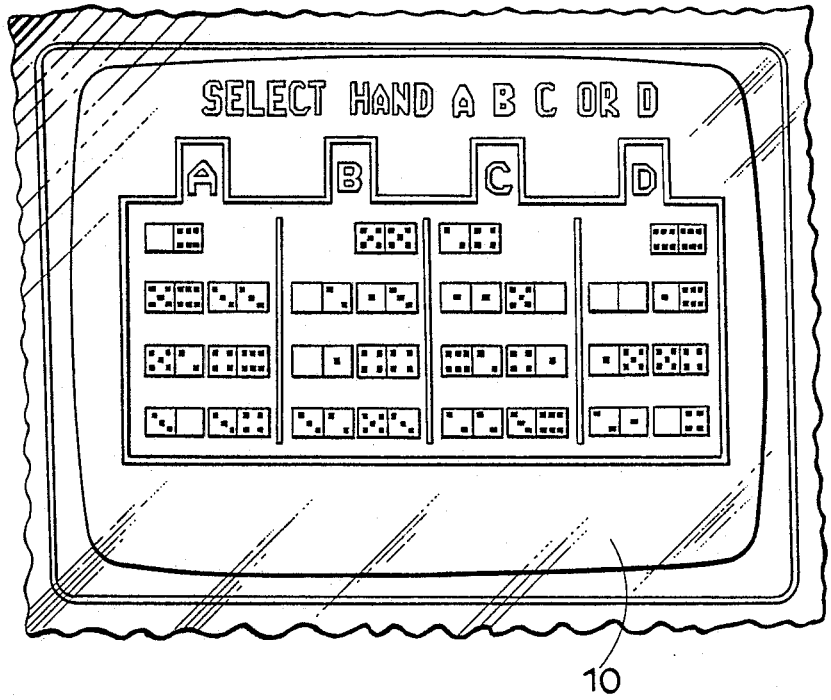
FIG. 2 is an enlarged view of a colour monitor of the machine presenting four pairs of hands of dominoes from which a player can choose.

With the machine switched on without credit, the monitor displays in an attract mode. This consists of the name 'Domino Skill' being drawn, then a display of 28 dominoes displayed face up and split into four hands of seven dominoes each (as in FIG. 1, and see also FIG. 2). These hands, selected by the machine from the register, are marked A, B, C and D. These two "attract mode" displays alternate while the machine is out of credit. It is to be noted that the four hands of dominoes so displayed do not change without a game being played; even if the machine were to be switched off and then on again, the same four hands would reappear. Only after a game has been played does the machine make a fresh selection of hands from the register.

Figure 3A:
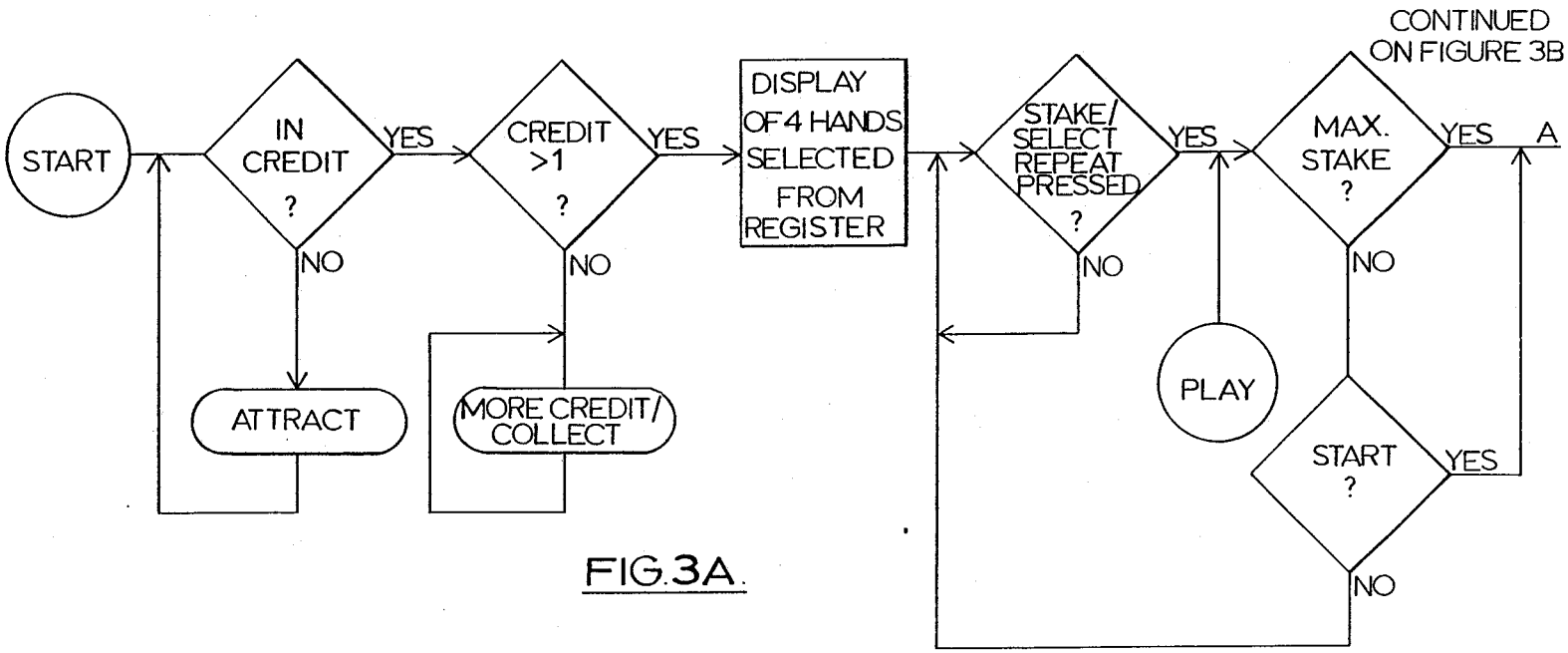
FIGS. 3A, 3B and 3C combine to show a flow chart illustrating the sequence in which a controlling microprocessor operates.
Figure 3B:
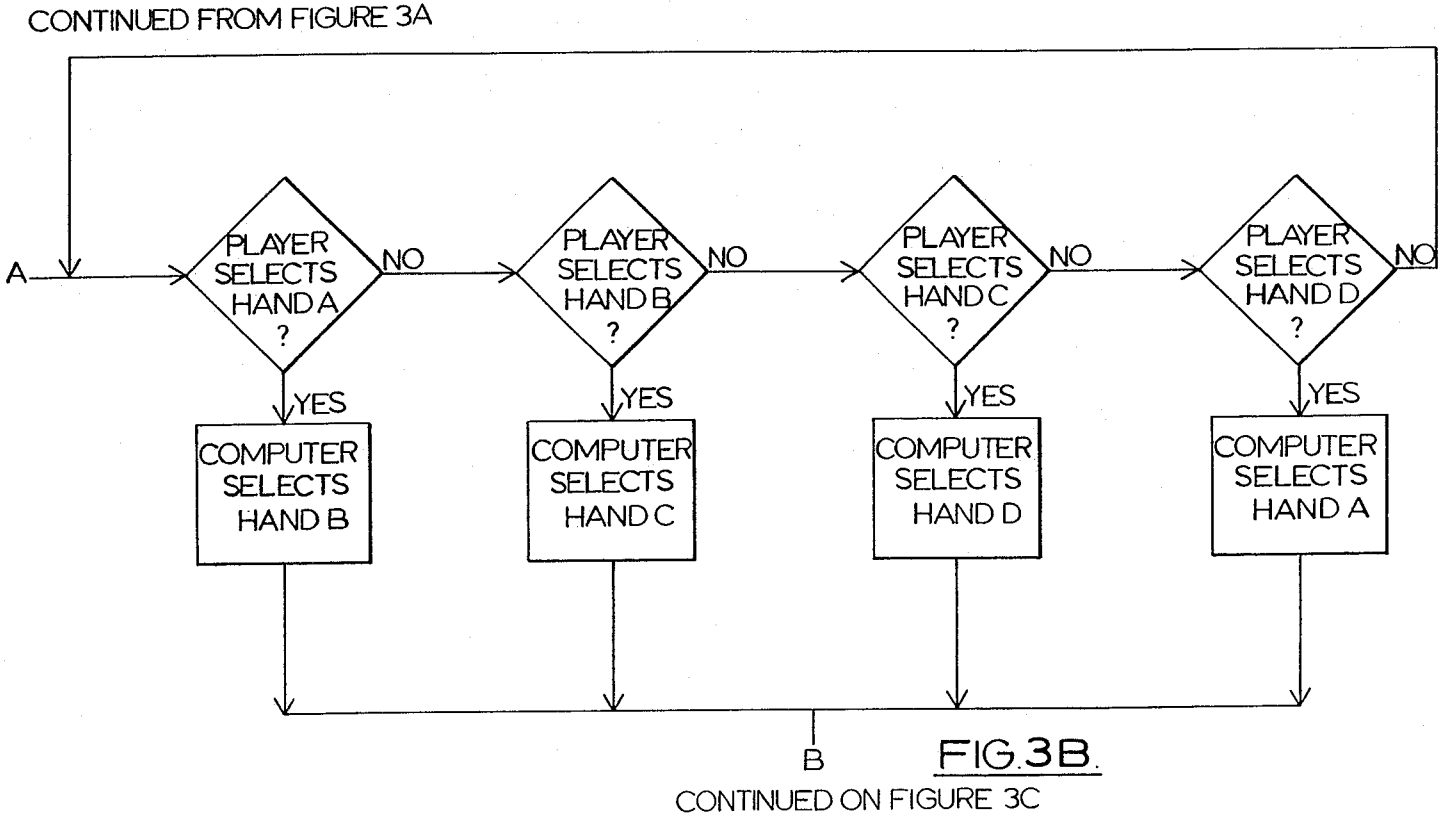
Figure 3C:
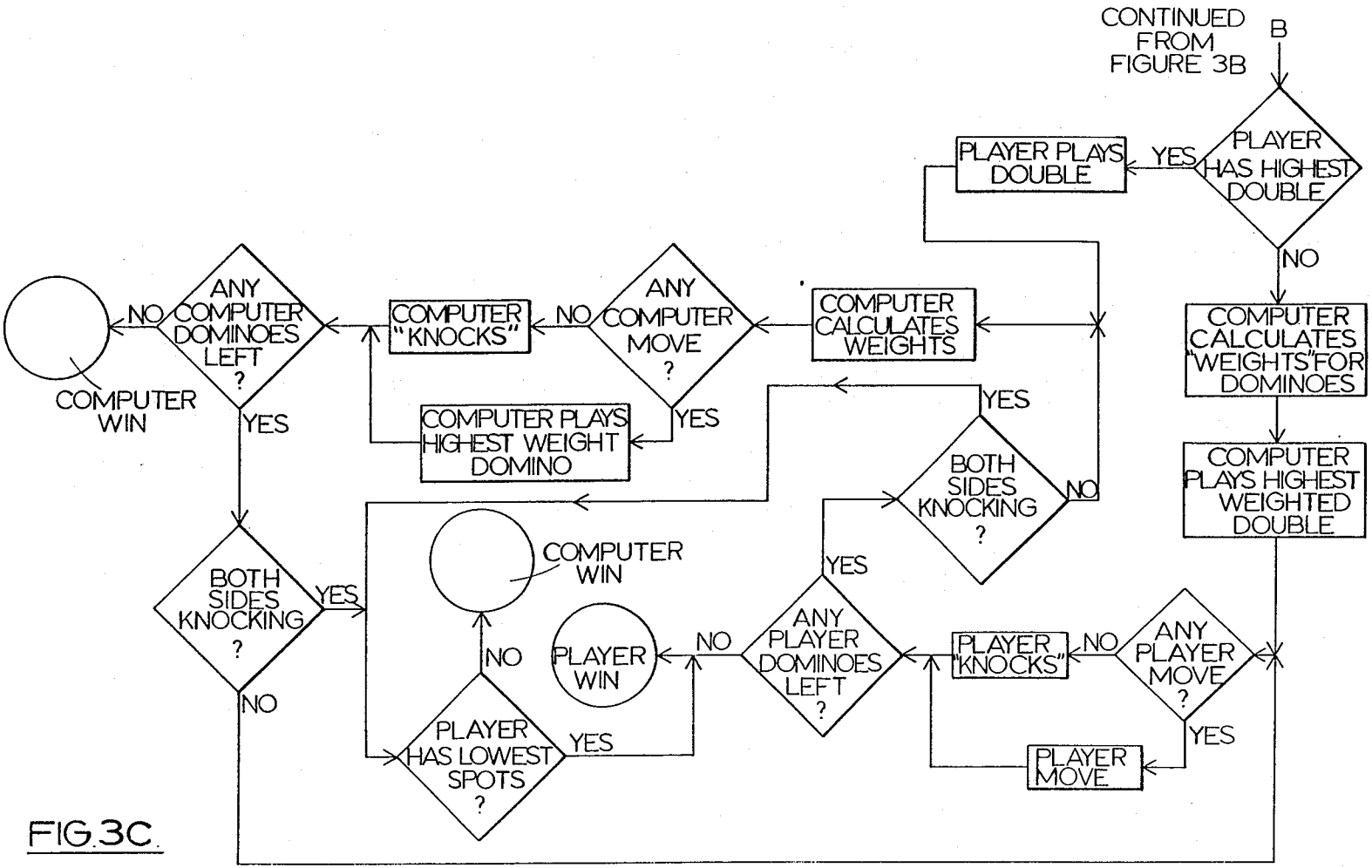

FIGS. 3A, 3B and 3C combine to show a flow chart illustrating the program steps in playing a game. When a player inserts coins into the machine, utilising the coin entry slots 16 and 18, the amount inserted is displayed on the credit display 20. Any number of coins may be inserted. At this time, the monitor 10 displays the four hands of the attract mode and invites the player to 'press stake select, or collect'. Even at this time, but before the player makes his stake, he may collect all the credits that have been inserted. Assuming the player wishes to play he presses a 'stake select' button 24 which causes credits to be taken from the credit display 20 and inserted on to the stake display 22. Any amount up to a predetermined maximum may be placed on to the stake. If the maximum stake has been placed the machine proceeds automatically, but otherwise the player then presses a start button 26. He is then asked to select hand A, B, C or D. From information displayed by the machine, he knows that according to whichever hand he chooses, the machine will respond with a certain hand as follows—A plays B, B plays C, C plays D, D plays A. Therefore the player is effectively presented with four pairs of hands to choose from, and always knows which hand he will be playing against. The player selects his hand, e.g. A, by use of the appropriate one of the buttons 12 provided, the machine taking hand B. The player's hand is then presented (still face up) along the bottom of the monitor 10. The machine's hand transfers (still face up) to the top of the monitor. The machine then considers both hands to see who possesses the highest weighted double. This decided, the side with the highest double is entitled to move first with a double. For example should the player hold the double six he will place this (or any other double), by means of the appropriate move button 14, and this goes to the centre of the monitor 10. It is now the machine's turn to place one of its dominoes, and it does so.

The game itself now follows the rules of that form of the traditional game of dominoes known as 'run-out' but, of course, all the dominoes are face up. The state of play is presented continuously on the monitor 10. Play continues alternately between the players until (a) one side has no playable domino and so is forced to "knock-"—he then misses his turn in favour of the other side, (b) one side gets all his dominoes out—he so wins that game, (c) both sides knock—the side with the lowest spot count on their remaining dominoes so wins, or (d) both sides knock and the spot count is equal—a drawn game and a further game is played with new hands.

If the player wins, his stake is transferred back on to the credit display 20 and an amount equal to the stake is also added. If he loses, the stake returns to zero, i.e. the machine retains the players' original stake. If after winning or losing the player wishes to collect his credits, this he can do at the end of any game by pressing a 'collect' button 28.

Each dominoe of the player's hand has its own illuminated move button 14 for the purpose of playing that individual domino. There also exists a placement button 30 enabling the player to place his chosen dominoe left or right of play.

There exists a stake repeat button 32 so that the player may (for speed) place his stake on his next game equal to the stake on his previous game.

During the presentation of the four hands in the attract mode, the selection of hands and the playing of the dominoes, the dominoes are at all times shown face up. At all times all the facts are known to the player and continue to be known for the entire duration of the game.

All payouts go on to the credit display 20 and may be collected in full at the end of any game.

All wins pay even money only.

I claim:

1. Games playing apparatus enabling a dominoes game to be played between a player and the apparatus, the apparatus comprising:

(a) means recording a register of notional pairs of hands of dominoes, the two hands of each pair being for allocation to the player and the apparatus for a game to be played;

(b) first selecting means operative automatically to select pairs of hands from said register to present to said player a choice of game to be played, the player so being informed what hand the apparatus will play for whichever hand the player selects from said choice;

(c) player-operated second selecting means operable to select one game from said choice presented, so determining the hand allotted to be played by said player and the hand allotted to be played by the apparatus;

(d) player-operated third selecting means operable in the player's turn to select from his allotted hand a dominoe to be played next;

(e) fourth selecting means operative automatically in the apparatus' turn to select from the apparatus' allotted hand a dominoe to be played next; and (f) display means operative to display representations of the dominoes face-up to the player to show:

(i) said choice of games selected by said first selecting means, (ii) said hands allotted respectively to said player and the apparatus by operation of said second selecting means, and (iii) the state of play as play proceeds.

* * * * *